United States Patent [19]

Tompkins et al.

[11] Patent Number: 4,766,710

[45] Date of Patent: Aug. 30, 1988

[54] COLUMN SUPPORT FOR DRYWALL PANEL

[76] Inventors: Charles A. Tompkins, Rte. 1, Box 65, Alvarado, Tex. 76009; William A. Hames, Rte. 5, Box 920, Burleson, Tex. 76028

[21] Appl. No.: 68,809

[22] Filed: Jun. 26, 1987

Related U.S. Application Data

[63] Continuation of Ser. No. 817,806, Jan. 10, 1986, abandoned, which is a continuation of Ser. No. 546,941, Oct. 31, 1983, abandoned.

[51] Int. Cl.[4] ..... E04B 2/30

[52] U.S. Cl. ..... 52/278; 52/275; 52/508

[58] Field of Search ..... 52/272, 275, 276, 278, 52/508, 279

[56] References Cited

U.S. PATENT DOCUMENTS

| | | | |
|---|---|---|---|
| 1,923,906 | 8/1933 | Berger | 52/356 |
| 2,076,728 | 4/1937 | Keller | 52/275 |
| 2,104,085 | 1/1938 | Leland | 52/509 |
| 2,317,634 | 4/1943 | Olsen | 52/285 |
| 2,877,874 | 3/1959 | Meyer | 52/275 |
| 3,206,806 | 9/1965 | Powell | 52/288 |
| 3,304,676 | 2/1967 | Sallie et al. | 52/276 |
| 3,500,600 | 3/1970 | Bagley, Sr. | 52/278 |
| 3,722,166 | 3/1973 | McNerney | 52/275 |
| 4,189,885 | 2/1980 | Fritz | 52/278 |

FOREIGN PATENT DOCUMENTS

| | | | |
|---|---|---|---|
| 0023373 | 2/1981 | European Pat. Off. | 52/276 |

OTHER PUBLICATIONS

Sweet's Catalog File 1985, McGraw Hill, § 9.6 Da (Dale Ind.) p. 7.

Construction Specialties, Inc. 1969, copyright 1968.

*Primary Examiner*—Carl D. Friedman

*Assistant Examiner*—Caroline D. Dennison

*Attorney, Agent, or Firm*—James E. Bradley

[57] ABSTRACT

A corner support strip for attaching a pair of wall panels to a concrete corner defined by a pair of perpendicular faces. The support strip has a pair of wall support sections, which are joined along one edge and are generally perpendicular to one another. A spacer section is attached to the outer edge of each wall support section and extends toward the column at a right angle. A flange extends from the edge of one of the spacer sections at a right angle away from the corner. The flange is attached to the face of the concrete corner, and the wall panels are attached to the wall support sections.

1 Claim, 1 Drawing Sheet

COLUMN SUPPORT FOR DRYWALL PANEL

This application is a continuation of application Ser. No. 817,806, filed 1/10/86 which was a continuation of Ser. No. 546,941 filed Oct. 31, 1983 both abandoned.

BACKGROUND OF THE INVENTION

1. Field of the Invention:

This invention relates in general to the mounting of wall panels and in particular to the mounting of wall panels on a corner defined by a pair of perpendicular faces, such as on the corner of a column.

2. Description of Prior Art:

The prior art method of mounting wall panels to concrete walls is illustrated in FIG. 1 in U.S. Pat. No. 3,722,166 (McNerney). The wall panels are not secured directly to the concrete walls, but rather, hat channels are first nailed into the concrete wall. The hat channels are generally C-shaped, with flanges on either end. Nails are driven through the flanges into the concrete wall. The wall panels are then fastened to the hat channels, leaving a space between the wall panels and the concrete walls.

It is preferable to use a corner strip to support the wall panels at the corner. Such support makes it easier to properly position metal corner strips, and also adds strength to the corner of the wall panels.

The corner strip disclosed in FIGS. 2–5 in the McNerny patent has a pair of wall support sections, joined along one edge and generally perpendicular to one another. The corner strip also has a pair of flanges, each of which is nailed to a respective concrete wall. The spacer sections between the wall support sections and the flanges are angled at a 45 degree angle from the planes of the wall panels and the concrete walls. While this system is feasible, a corner strip requiring fewer nails and less labor to install would be desirable.

SUMMARY OF THE INVENTION

The improved corner support strip of the invention has a pair of wall support sections, joined along one edge and generally perpendicular to one another. The support strip thus fits within the corner formed by the intersection of two wall panels. A spacer section is attached to the outer edge of each wall support section at right angles, so that the spacer sections extend between the wall panels and the perpendicular faces of a concrete corner. A flange extends from the edge of one of the spacer sections at a right angle away from the corner. This flange is nailed directly to the concrete wall. The other spacer section, the one not having a flange, directly abuts against the concrete face. The above, as well as additional objects, features, and advantages of the invention will become apparent in the following detailed description.

DESCRIPTION OF THE PREFERRED EMBODIMENT

Figure 1:
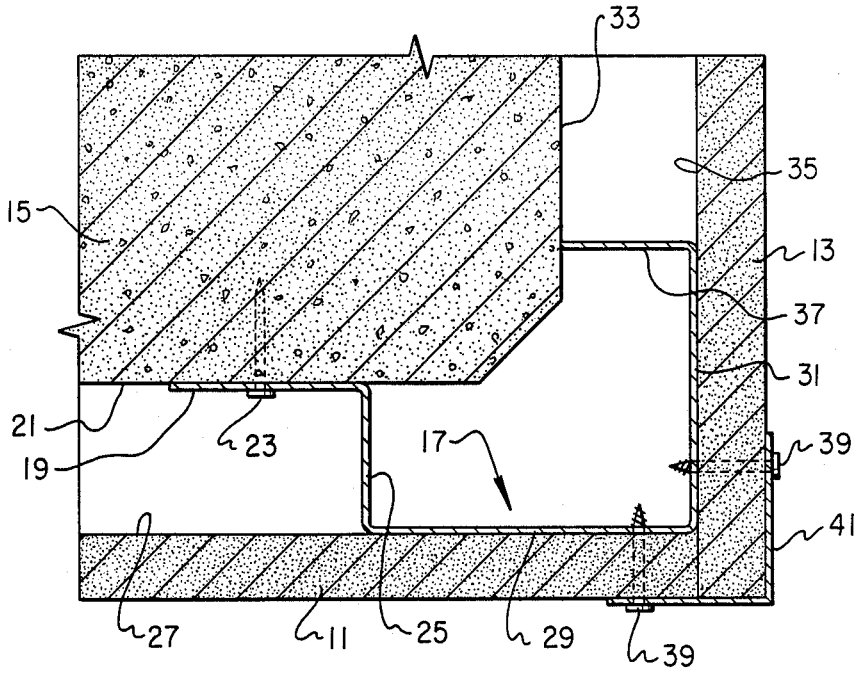
FIG. 1 is a sectional top view of a pair of wall panels mounted on the corner of a concrete column by means of the corner support strip of the invention.
Figure 2:
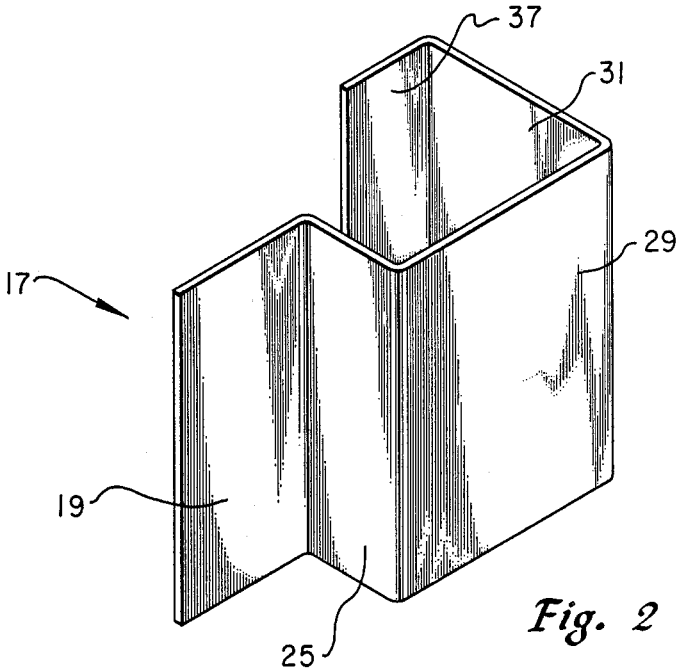
FIG. 2 is a perspective view of a corner support strip.

FIG. 1 illustrates a pair of wall panels 11, 13 mounted to a concrete corner 15. The concrete corner 15 may be the intersection of two concrete walls, or one corner of a generally rectangular concrete column. The wall panels 11, 13 may be wall board of any type.

The corner formed by the intersection of the two wall panels 11, 13 is mounted to the concrete corner 15 and is supported by a corner support strip 17. The corner support strip 17 has a flange 19 which is secured to one face 21 of the concrete corner 15 by means of conventional concrete nails 23. The flange 19 is thus the attachment means for attaching the corner support strip to the concrete corner 15. A spacer section 25 extends from one end of the flange 19 at a right angle to the face 21 of the concrete corner 15. The spacer section 25 extends from the face 21 of the concrete wall 15 to the inside surface 27 of the wall panel 11.

A wall support section 29 extends from the outside end of the spacer section 25. The wall support section 29 is perpendicular to the spacer section 25, and thus is parallel to the flange 19, the face 21 of the concrete corner 15, and the inside surface 27 of the wall panel 11. A second wall support section 31 is perpendicular to the first wall support section 29. The second wall support section 31 is thus parallel to the second face 33 of the concrete corner 15 and the inner surface 35 of the second wall panel 13.

At the outer end of the second wall support section 31, a second spacer section 37 extends from the inner surface 35 of the wall panel 13 to the second face 33 of the concrete corner 15. It is not necessary, nor preferred, to provide a flange 19 on the second spacer section 37. The spacer section 37 is perpendicular to and its free edge abuts directly against the face 33. The free or outer edge has no flange or other structure attached to it.

The wall panels 11, 13 are attached to the wall support sections 29, 31 by means of conventional fastners such as screws 39. A metal corner strip 41 will normally be attached to the wall panels 11, 13 in order to protect the exposed corner of the wall panel 13.

In operation the corner support strip 17 is first attached to the face 21 of the concrete corner 15 by driving concrete nails 23 through the flange 19. The wall panels 11, 13 are then attached to the wall support sections 29, 31 with screws 39. A corner strip 41 may also be attached to the wall panels 11, 13 with the screws 39.

The corner support strip 17 of the invention provides several advantages over the prior art. Since the spacer sections 25, 37 are perpendicular to the faces 21, 33 of the concrete corner 15, and to the wall panels 11, 13, the corner support strip 17 provides a stronger support to the wall panels 11, 13. Also, since only one flange 19 is required, only half, or less as many concrete nails 23 are required as in the prior art. Thus the corner support strip 17 is not only stronger, but also more economical in terms of both time and material.

While the invention has been shown in only one of its forms, it should be apparent to those skilled in the art that it is not so limited, but is susceptible to various changes and modifications without departing from the spirit thereof.

We claim:

1. A corner construction comprising a pair of wall panels attached to a corner defined by the intersection of a pair of vertical perpendicular faces, including a corner support strip consisting essentially of the following:

first and second wall support sections integral with each other and which are generally perpendicular to one another;

a first spacer section integral to and extending from the first wall support section perpendicular to the first wall support section and parallel to the second wall support section;

a second spacer section integral to and extending from the second wall support section perpendicular to the second wall support section and parallel to the first wall support section, the second spacer section consisting essentially of a flat member that lies in a single plane and terminates with a free edge in the same plane and opposite the junction of the second spacer section and the second wall support section; and a single flange integral to and extending from the first spacer section at a right angle to the first spacer section and on the opposite side of the first spacer section from the first wall support section;

whereby the flange is placed against one of the faces of the corner and the free edge of the second spacer section abuts against the other face of the corner;

the corner support strip is fastened to the corner by fasteners extending only through the flange into one of the faces of the corner; and screws are inserted through the wall panels and into the wall support sections to attach the wall panels to the corner strip.

* * * * *